US011265666B2

(12) United States Patent
Thukral et al.

(10) Patent No.: US 11,265,666 B2
(45) Date of Patent: Mar. 1, 2022

(54) MICROPHONE DEVICE WITH COMMUNICATION INTERFACE

(71) Applicant: Knowles Electronics, LLC, Itasca, IL (US)

(72) Inventors: Saket Thukral, Lisle, IL (US); Lane Schaller, Western Springs, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/846,237

(22) Filed: Apr. 10, 2020

(65) Prior Publication Data

US 2020/0329325 A1 Oct. 15, 2020

Related U.S. Application Data

(60) Provisional application No. 62/833,617, filed on Apr. 12, 2019.

(51) Int. Cl.
*H04R 29/00* (2006.01)
*H04R 1/04* (2006.01)
*H04R 19/04* (2006.01)

(52) U.S. Cl.
CPC ..... *H04R 29/005* (2013.01); *H04R 1/04* (2013.01); *H04R 19/04* (2013.01)

(58) Field of Classification Search
CPC ..... H04R 19/02; H04R 19/04; H04R 19/016; H04R 19/005; H04R 19/00; H04R 19/013;
(Continued)

(56) References Cited

U.S. PATENT DOCUMENTS 9,420,391 B2 * 8/2016 Wiesbauer ..... H04R 29/004
9,478,234 B1 * 10/2016 Nandy ..... G10L 25/78
(Continued)

FOREIGN PATENT DOCUMENTS

EP 3637798 A1 4/2020
WO WO-2018081278 A1 * 5/2018 ..... G06F 13/4282
(Continued)

OTHER PUBLICATIONS

Pawlowski, U.S. Appl. No. 17/004,001, U.S. Patent and Trademark Office, filed Aug. 27, 2020.
(Continued)

*Primary Examiner* — Ahmad F. Matar
*Assistant Examiner* — Sabrina Diaz
(74) *Attorney, Agent, or Firm* — Loppnow & Chapa; Matthew C. Loppnow; Roland K. Bowler, II

(57) ABSTRACT

This disclosure provides methods, systems, and apparatuses, for a microphone. In particular, the microphone includes a housing having an external device interface with a plurality of contacts including a data contact. An electro-acoustic transducer is configured to generate an electrical signal in response to sound. An electrical circuit is coupled to contacts of the interface, the electrical circuit including an ADC having an input coupled to an output of the conditioning circuit and configured to convert the electrical signal to audio data after conditioning. A controller is configured to communicate data, other than the audio data, via the data contact of the external device interface during a start-up transition period of the microphone assembly, wherein the controller is configured to communicate the audio data via the data contact of the external device interface only after the start-up transition period is complete.

18 Claims, 8 Drawing Sheets

(58) Field of Classification Search
CPC . H04R 1/04; H04R 1/08; H04R 1/083; H04R 1/086; H04R 1/005; H04R 1/406; H04R 25/00; H04R 25/604; H04R 25/407; H04R 9/08; H04R 9/06; H04R 11/06; H04R 3/00; H04R 3/005; H04R 3/08; H04R 3/04; H04R 23/004; H04R 17/00; H04R 17/005; H04R 17/02; H04R 2201/401; H04R 2201/403; H04R 2201/003; H04R 29/005; H04M 1/03; H03F 1/26; H03F 1/305; H03F 3/183; H03F 3/1855; G01S 1/72; B64C 27/026; C01B 33/32; H01H 59/00; H02N 11/006
USPC ..... 381/92, 111–117, 355, 368, 174
See application file for complete search history.

(56) References Cited

U.S. PATENT DOCUMENTS

| | | | | |
|---|---|---|---|---|
| 9,749,736 | B2 * | 8/2017 | Cagdaser | H04R 3/00 |
| 9,866,938 | B2 | 1/2018 | Popper et al. | |
| 9,894,437 | B2 | 2/2018 | Pawlowski | |
| 10,165,359 | B2 | 2/2018 | Pawlowski | |
| 10,721,557 | B2 | 7/2020 | Pawlowski et al. | |
| 2005/0078841 | A1 * | 4/2005 | Boor | H03F 3/185 381/113 |
| 2009/0003629 | A1 * | 1/2009 | Shajaan | H04R 19/04 381/113 |
| 2014/0257813 | A1 * | 9/2014 | Mortensen | G10L 15/22 704/251 |
| 2014/0321664 | A1 * | 10/2014 | Huang | H04R 29/005 381/92 |
| 2015/0256914 | A1 * | 9/2015 | Wiesbauer | H04R 3/00 381/174 |
| 2016/0277844 | A1 * | 9/2016 | Kopetz | H04R 19/005 |
| 2018/0308511 | A1 * | 10/2018 | Dai | G10L 25/78 |
| 2019/0132682 | A1 * | 5/2019 | Fan | H04R 19/04 |
| 2019/0253810 | A1 | 8/2019 | Pawlowski et al. | |
| 2020/0110570 | A1 * | 4/2020 | Russell | G10L 15/285 |

FOREIGN PATENT DOCUMENTS

| | | | | |
|---|---|---|---|---|
| WO | WO-2018126151 | A1 * | 7/2018 | G06Q 20/40145 |
| WO | 2019133645 | A1 | 7/2019 | |
| WO | 2020076846 | A1 | 4/2020 | |

OTHER PUBLICATIONS

Fobel, PCT International Search Report, International application No. PCT/US2020/027844, European Patent Office, Rijswijk, NL, Jul. 20, 2020.

Nielsen, "Toward More-Compact Digital Microphones," URL:https://www.analog.com/media/en/analog-dialogue/volume-41/number-3/articles/toward-more-compact-digital-microphones.pdf, Sep. 2007.

* cited by examiner

MICROPHONE DEVICE WITH COMMUNICATION INTERFACE

BACKGROUND

Several audio sensing applications include electronic microphones. Some such microphones include microelectromechanical systems (MEMS) microphones, e.g., capacitive microphones, the capacitance of which changes as a function of incident changes in pressure. The microphones transform the change in capacitance into corresponding electrical signals indicative of acoustic activity sensed by the microphones.

BRIEF DESCRIPTION OF THE DRAWINGS

FIG. 5A shows an example timing diagram illustrating a start-up transition period after power on.

DETAILED DESCRIPTION

Figure 1:
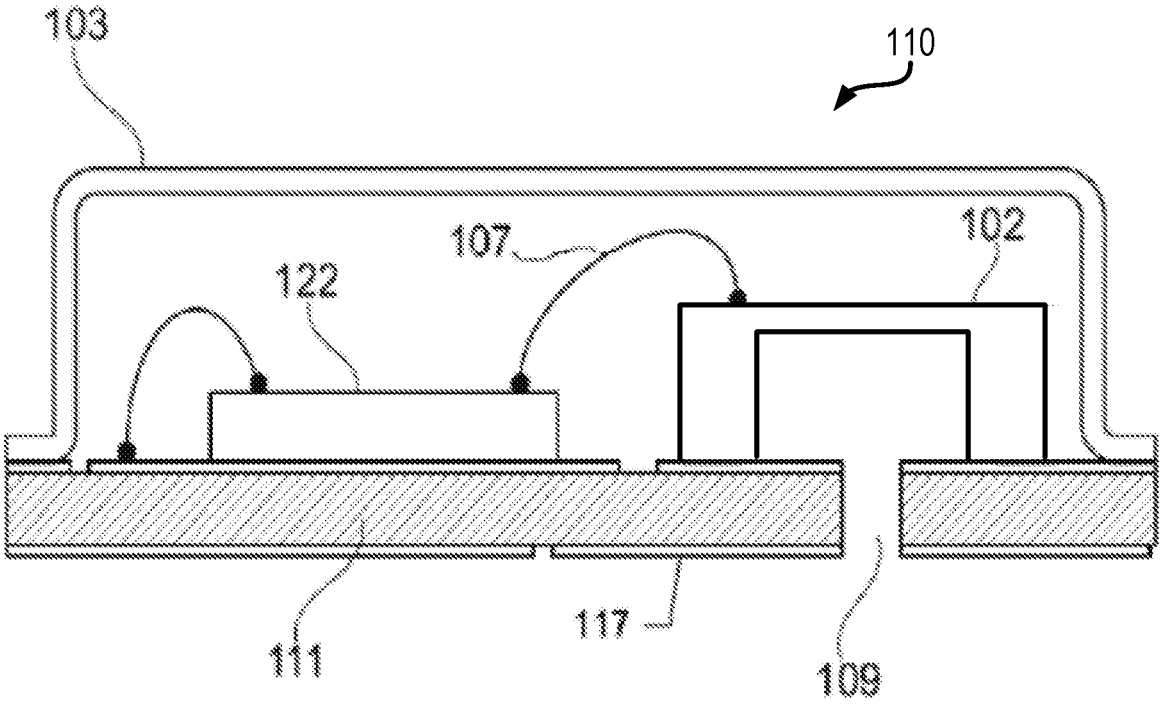
FIG. 1 illustrates an exemplary embodiment of a microphone assembly.

The present disclosure describes devices and techniques for communicating data other than audio data from a data contact of an external device interface of a microphone assembly. The microphone assembly can include a housing or a package that houses an electro-acoustic transducer that can generate an electrical signal responsive to sound. The housing can also house an electrical circuit that can convert the electrical signal into a digital audio signal that can be transmitted to an external device via the data contact of the external device interface. When the microphone assembly is enabled (based on a power supply and a clock signal), the audio signal is not transmitted for a certain period of time. During this time period, components of the microphone assembly, such as the electrical circuit that processes the signal from the transducer, may be performing start-up activities to ready the microphone to provide a reliable audio signal at the output of the microphone assembly. This period of time, referred to as a start-up transition period, is utilized to power up various components of the transducer assembly, such as, for example, the electro-acoustic transducer, a charge-pump, conditioning circuitry, analog-to-digital converter, etc. No digital audio signal may be transmitted during the start-up transition time period. One possibility during this start-up transition period is to output nothing at the output of the microphone assembly. Another possibility is to output a dummy signal, such as a signal exemplifying noise or an ambient pressure signal. In either possibility, the start-up transition period is essentially wasted and no useful information is communicated between the microphone assembly and a host device to which the microphone assembly is communicatively coupled.

The present disclosure provides example devices and methods for utilizing the start-up transition period to communicate data with other devices via the data contact. The communication can include data other than the digital audio data. The communication can include both receiving and transmitting data over the data contact during the start-up transition period. After the start-up transition period is completed, the microphone assembly can cease communicating the data and begin transmitting the digital audio signal representative of the electrical signal generated by the transducer. Thus, data that would otherwise be communicated by interrupting the digital audio signal, can instead be communicated during the start-up transition period over the same data contact. In some embodiments, the microphone assembly may avoid interrupting the audio signal at all by utilizing the start-up transition period to communicate data other than the audio data. In some embodiments, the microphone assembly may still interrupt the audio signal at times to communicate other data, but may do so less frequently than would otherwise be done in absence of using the start-up transition period to communicate other data. While the present techniques are applicable to devices having any number of data contacts, they may be particularly useful with devices having only a single data contact, or a small number of data contacts, such as devices with no dedicated data contact for communicating data other than the audio signal. The present techniques are also applicable to devices utilizing various electrical interfaces for data transfer, such as, for example, pulse-density-modulation (PDM), Inter-IC Sound (I2C), SoundWire, etc.

In some instances, the start-up transition period can be a period during which a subset of the electrical components of the microphone assembly are initialized prior to providing the digital audio signal to the data contact. The microphone assembly can determine a start of the start-up transition period by sensing the power supply voltage and the clock frequency received to be greater than their respective threshold values. In some instances, the microphone assembly can store auxiliary data in memory, which can be communicated via the data contact during the start-up transition time period. The auxiliary data can include microphone calibration data, microphone performance data, microphone status data, microphone diagnostic data, etc. In some instances, the microphone assembly can transmit the auxiliary data in response to receiving command signals from an external device via the data contact.

FIG. 1 illustrates an exemplary embodiment of a microphone assembly 110. The microphone assembly 110 includes an electro-acoustic transducer that can generate an electrical signal in response to sound. The electro-acoustic transducer, can include, for example, a capacitive microelectromechanical system (MEMS) transducer 102. While not shown in FIG. 1, the MEMS transducer 102 includes first and second transducer plates embodied as a diaphragm and a back plate. A charge or bias is applied to the diaphragm and back plate by a DC charging circuit (not shown). The diaphragm includes a pierce or other pressure relief aperture structured to provide pressure equalization between pressure of an internal volume of the microphone assembly 110 and a pressure of the outside environment. In other embodiments, the electro-acoustic transducer may be a piezoelectric transducer or some other known or future transducer, any one of which may be implemented as a MEMS die or as some other device.

The microphone assembly 110 also includes an electrical circuit (also referred to as a processing circuit) 122 which may be implemented as one or more semiconductor die. In some implementations, the electrical circuit 122 is implemented as an application specific integrated circuit ("ASIC"). In some implementations, the electrical circuit 122 is implemented as a mixed-signal CMOS semiconductor device integrating analog and digital circuits. The MEMS transducer 102 and the electrical circuit 122 are shaped and sized for mounting in a housing of the microphone assembly 110. The housing is formed by a lid 103 mounted on the substrate 111 such that the lid and substrate jointly form an interior volume or cavity within the housing enclosing and protecting the MEMS transducer 102 and the electrical circuit 122. The housing includes a sound inlet or port 109 through the substrate 111, or through the lid in other embodiments, for conveying acoustic energy to the MEMS transducer 102. The MEMS transducer 102 may include an output pad or terminal that is electrically coupled to the electrical circuit 122 via one or more interconnecting wires 107. For surface mount devices, an essentially plane outwardly oriented lower surface 117 or external-device interface of the substrate 111 includes a plurality of external contacts, an example of which is illustrated in FIG. 2.

The acoustic sensor of FIG. 1 is one example of a transducer assembly 110. In other implementations of the disclosure, the transducer assembly 110 could be embodied as a pressure sensor, a temperature sensor, a gas sensor, and an ultrasonic sensor, among other sensors that include an interface for communicating with a host or external device using a standard or proprietary protocol. The acoustic sensor could also be embodied as a combination of one or more of the foregoing sensors, for example, an acoustic sensor having integrated therewith one or more of a temperature sensor, a pressure sensor, a gas sensor, etc.

Figure 2:
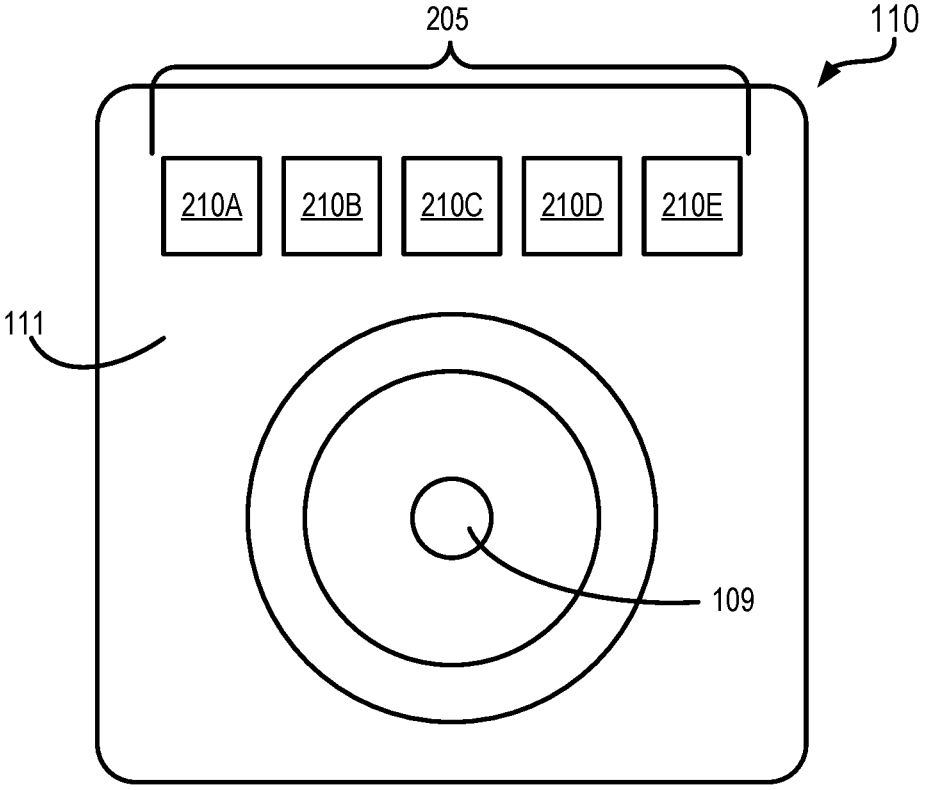
FIG. 2 illustrates a bottom view of the microphone assembly having an external device interface including a plurality of externally accessible contacts.

FIG. 2 illustrates a bottom view of the microphone assembly 110 having an external device interface 205 including a plurality of externally accessible contacts 210A, 210B, 210C, 210D, and 210E. Other microphone or transducer assemblies may include more or fewer contacts. Each of the contacts 210A through 210E may, for example, include a solder pad or bump for reflow soldering the transducer assembly onto a carrier substrate of a host device. As noted, the carrier substrate may be embodied as a printed circuit board, which may also support a host processor and bus lines or wires (e.g., CLK and DATA among others depending on the protocol and the particular application) coupled to the host processor. In FIG. 2, the externally accessible contacts 210A through 210E are rectangular with substantially identical size and are spaced apart with a suitable pitch or separation. Contacts in other embodiments may have other shapes, arrangements and spacing. In FIG. 2, for example, the microphone assembly 110 may include an additional contact shaped as a circular solder-ring surrounding the sound port 109. The additional contact may be a ground connection of the microphone assembly 210.

In some instances, the contacts 210A through 210E can correspond to a data contact (DATA), a clock contact (CLK), a supply voltage contact (VDD), a ground contact (GND), and a selection contact (SEL). The DATA contact can be utilized to communicate data with one or more devices external to the microphone assembly 110. In some instances, the microphone assembly 110 may include only a single contact, such as the DATA contact, via which the microphone assembly 110 can communicate data. The microphone assembly 110 may utilize no other contact other than the DATA contact via which to communicate data and the audio data. In some embodiments, the microphone assembly 110 can communicate data and audio data over the same set of contacts. For example, if the microphone assembly 110 utilized two contacts to output audio data, then the microphone assembly 110 may utilize only those two contacts to communicate data other than the audio data. The CLK contact can receive a clock signal that can be used to operate digital circuitry within the microphone assembly 110. The VDD contact can receive a supply voltage to power the microphone assembly 110. The GND contact can be connected to an external ground plane. The SEL contact can provide a control voltage that indicates the clock edge on which the microphone assembly 110 should output data. For example, in stereo applications, the DATA contacts of two microphone assemblies can be coupled to a common data interconnect, which may, in turn, be connected to a data consuming device. In some such instances, the SEL contact of one microphone assembly can be connected to GND while the DATA contact of the other microphone assembly can be connected to VDD. In such a configuration, one microphone assembly communicates data on the rising edge of the clock signal, while the other microphone assembly communicates data on the falling edge of the clock signal. In this manner, the data interconnect is time multiplexed to carry communication data from two microphone assemblies.

Figure 3:
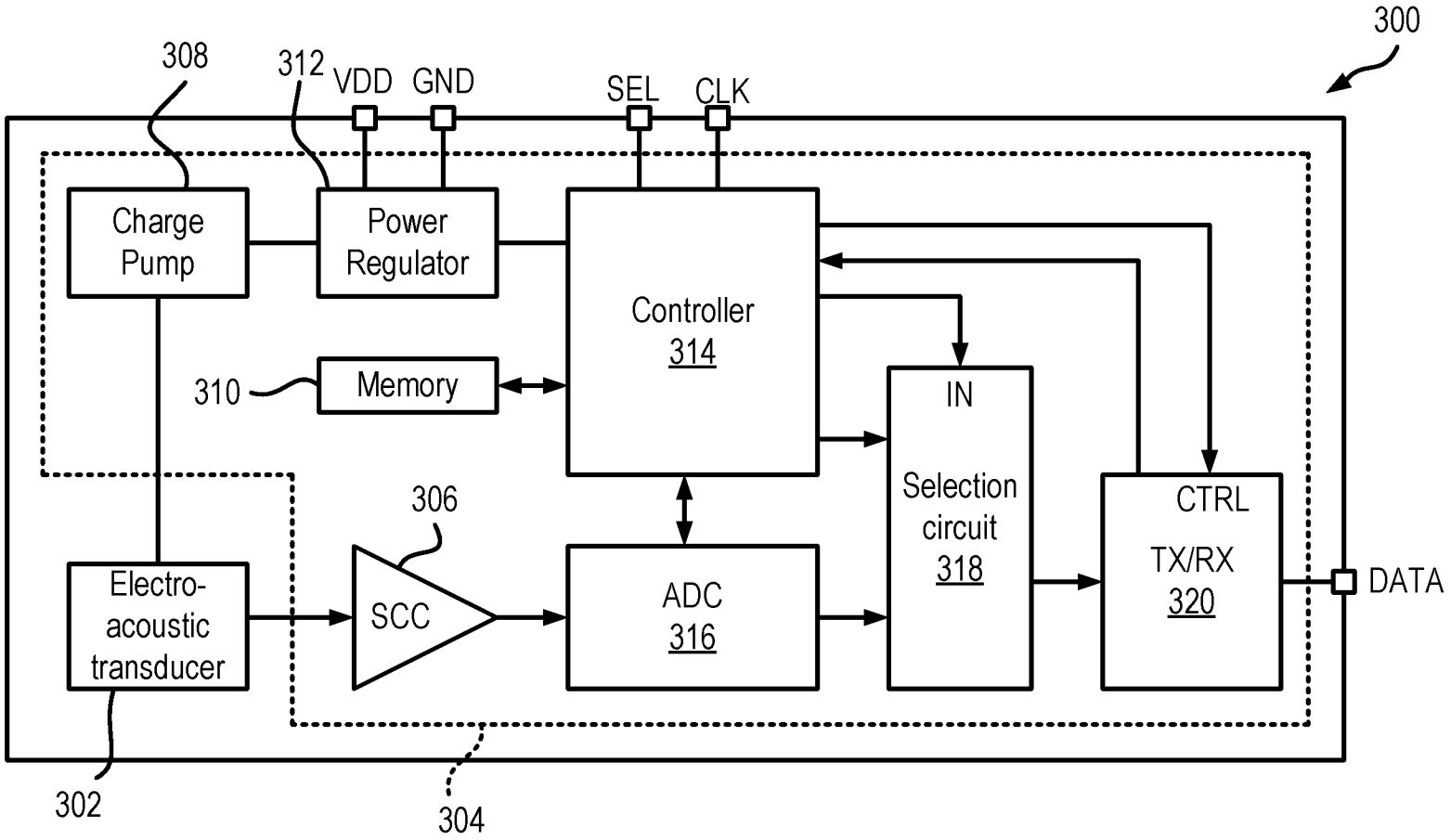
FIG. 3 shows a block diagram of an example digital microphone assembly.

FIG. 3 shows a block diagram of an example digital microphone assembly 300. The digital microphone assembly 300 ("microphone 300") can be utilized to implement, for example, the microphone assembly 100 discussed above in relation to FIGS. 1 and 2. The microphone 300 can include an electro-acoustic transducer 302 ("transducer 302") electrically coupled with an electrical circuit 304. The electrical circuit 304 can include several analog and digital circuit components, such as, for example, a signal conditioning circuit 306, an analog-to-digital converter (ADC) 316, a charge pump 308, a power regulator 312, memory 310, a controller 314, a selection circuit 318, and a transceiver 320. The electrical circuit 304 may include additional or fewer components that that shown in FIG. 3. The transducer 302 and the electrical circuit 304 can be housed in a housing such as, for example, the housing shown discussed above in relation to FIGS. 1 and 2. Additionally, the electrical circuit 304 can be electrically coupled with the external device interface including one or more contacts, such as, for example, the external device interface 205 discussed above in relation to FIG. 2. In particular, the electrical circuit 304 can be electrically coupled with the DATA contact, the GND contact, the VDD contact, the SEL contact, and the CLK contact.

The power regulator 312 can include a voltage regulator or converter that can convert the power received at the VDD and GND contacts into voltages and currents appropriate for operating various components of the electrical circuit 304. While not shown in FIG. 3, the power regulator can be electrically coupled with all the electrical components of the electrical circuit 304. The charge pump 308 can provide a sufficiently high voltage for the operation of the transducer 302. In some instances, the charge pump can be a voltage multiplier, which multiplies the voltage received from the power regulator into a voltage level appropriate for the operation of the transducer 302. The transducer 302, as mentioned above, can generate an electrical signal in response to sound or pressure. The electrical signal generated by the transducer 302 can be processed by the signal conditioning circuit 306 at least one input of which is coupled with an output of the transducer 302. The signal conditioning circuit 306 can include one or more of a filter, an amplifier, a level shifter, etc., that can process the analog signal generated by the transducer 302 to be in a condition (e.g., min/max voltage levels and frequencies) that are specified by the ADC 316. The ADC 316 can have at least one input coupled with an output of the SCC 306, and can convert the conditioned electrical signal output by the SCC 306 into a digital audio signal. In some instances, the ADC 316 may also include an encoder, such that the digital audio signal output by the ADC 316 is a digitally modulated signal, such as, for example, a pulse density modulated (PDM) or a pulse code modulated (PCM) signal.

The controller 314 can include a logic circuit (digital/analog) that can control the operation of various components of the electrical circuit 304. As an example, the controller 314 can be implemented using a microcontroller or a microprocessor. The controller 314 can be coupled to the SEL contact and the CLK contact. The SEL contact, as discussed above, can indicate the clock edge on which the microphone assembly is to communicate data. The controller 314 can control the ADC 316, selection circuit 318 and the transceiver 320 to output the digital audio signal on the DATA contact at the appropriate clock edge. The selection circuit 318 can include at least two inputs, one of which is coupled with the controller 314 and another one of which is coupled with the ADC 316. The selection circuit 318 can include at least one output that is coupled with the DATA contact, for example, via the transceiver 320. The selection circuit 318 can also include a selection control input (IN) that is coupled with the controller 314. The controller 314 can output a control signal to the selection circuit 318 to select one of the inputs (e.g., the output of the ADC 316 and the output of the controller 314) to the output of the selection circuit 318. The transceiver 320 can receive and transmit data over the DATA contact. For example, the transceiver 320 can transmit the digital audio signal or the data from the controller received via the selection circuit 318 via the DATA contact. The transceiver 320 can also receive data over the DATA contact and provide the data to the controller. The controller 314 can control the operation of the transceiver (e.g., whether the transceiver 320 is operating in a transmit mode or a receive mode) by sending a control signal to the CTRL input of the transceiver 320. The transceiver 320 can include drivers or buffers that can have high current output to transmit data on the DATA contact. The transceiver 320 can also include drivers or buffers that can sense voltage representative of data on the DATA contact and provide the data to the controller 314.

The memory 310 can be coupled with the controller 314, and allow the controller 314 read and write access to at least a portion of the contents of the memory 310. The memory 310 can include one or more of a volatile memory (e.g., RAM, SRAM, DRAM, etc.) or a non-volatile memory (ROM, EPROM, EEPROM, Flash, etc.). The memory 310 can store auxiliary data related to the microphone 300. For example, the auxiliary data can include calibration data, microphone performance data, microphone status data, sensor data, customer request data, microphone diagnostic data, and/or a sync pattern. The sensitivity of the microphone 300 can vary over time. In such instances, the controller 314 may store the sensitivity value of the microphone 314 in memory. In some instances, it may be beneficial for a consuming device, to which the microphone 300 provides audio data, to have a current sensitivity value of the microphone 300. The mic status data can include data regarding the status of one or more components of the microphone 300. For example, the status data can include an indication of the operation status of the transducer 302 (e.g., struck MEMS transducer, contaminant on transducer, etc.). The performance data can include performance metrics of the microphone that may be determined by the controller 314. The performance data may include processor speed, transducer response time, etc. The status data can also include the threshold current level of the power supply, the state of the clock, a fault state of the controller, etc. The diagnostic data can include results of diagnostics carried out on the microphone, and can include status data, etc. The sensor data can include values for temperature, pressure, or other sensors that may be installed in the microphone in addition to the transducer 302. Consumer request data can include proprietary data that a customer can store in the memory. Sync pattern data can include a bit pattern that can indicate a start and stop of auxiliary data. For example, when communicating data over the DATA contact, the controller 314 can include the bit pattern in the data so that the receiving device can detect the start and the stop of the auxiliary data. The memory 310 can also store instructions that the controller can execute to control the operation of the microphone 300. The auxiliary data stored in memory 310 also can include manufacturing data of the microphone 314, such as, for example, a model number, a date of manufacture, and a location of manufacture of the microphone 314.

Figure 4:
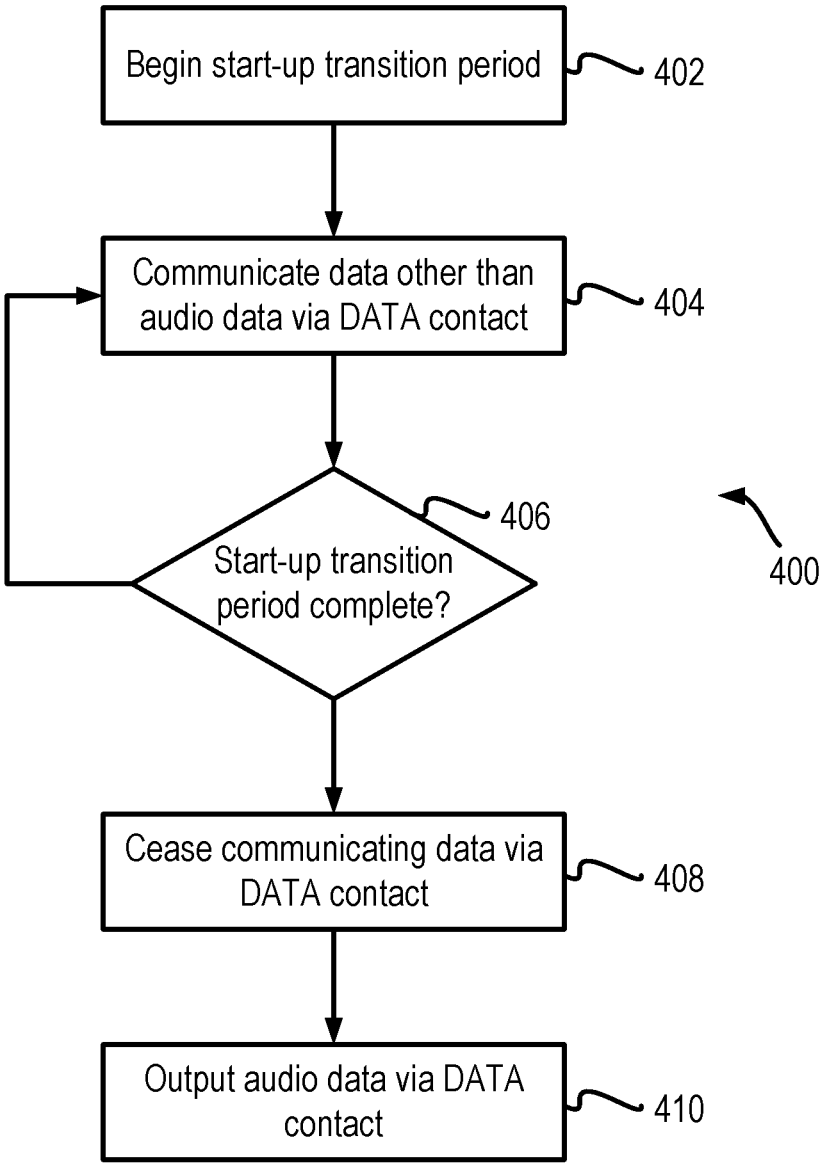
FIG. 4 shows a flow diagram of an example process for communicating data via a start-up transition period.

FIG. 4 shows a flow diagram of an example process 400. The process 400 can be executed, for example, by the controller 314 discussed above in relation to FIG. 3. In some instances, instructions corresponding to the process 400 can be stored in the memory 310. The process includes beginning a start-up transition period (402). The start-up transition period may begin based on the power supply and the clock signal provided to the microphone 300. For example, the controller 314 can detect a start-up transition period when the controller transitions into an operational state from a previous in-operational state. For example, the controller may become in-operational if either the clock signal on the CLK contact or the voltage signal at the VDD supply were to be disabled, removed, or reduced below respective threshold values. When both the clock signal and the supply voltage are provided to the microphone 300, the controller 314 can become operational and the start-up transition time period can begin.

Figure 5A:
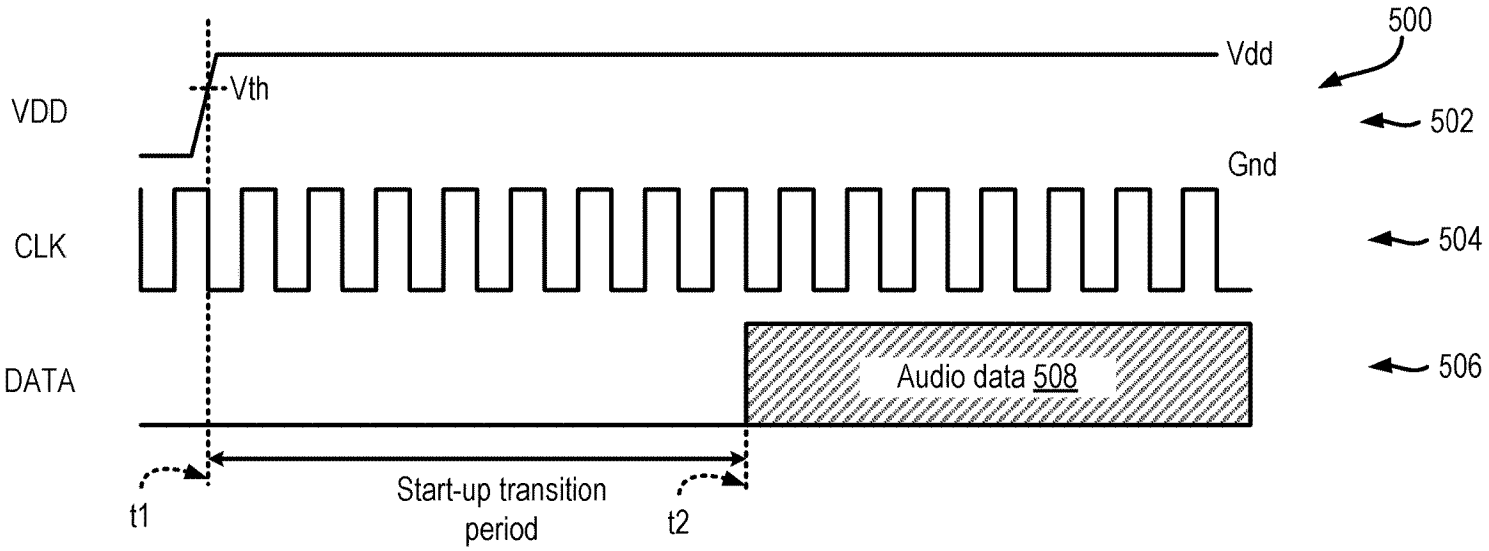

FIG. 5A shows an example timing diagram 500 illustrating a start-up transition period after power on. The example timing diagram 500 includes a voltage waveform 502 indicating the voltage level at the VDD contact of the microphone 300, a clock signal waveform 504 indicating the clock signal voltage level at the CLK contact of the microphone 300, and a data waveform 506 indicating the communication on the DATA contact of the microphone 300. In the example shown in FIG. 5A, the clock signal is present and above a threshold frequency at the CLK contact of the microphone 300 before the start-up transition period. That is, before the start-up transition period begins, the microphone 300 may be in a power down mode, where the voltage level on the VDD contact of the microphone 300 may be pulled low, but the clock signal at the CLK contact is present. When the power is switched back on, the voltage level on the VDD contact begins to increase. When the voltage increases above a threshold voltage Vth at time t1, the controller 314 can determine that the start-up transition period has begun.

Figure 5B:
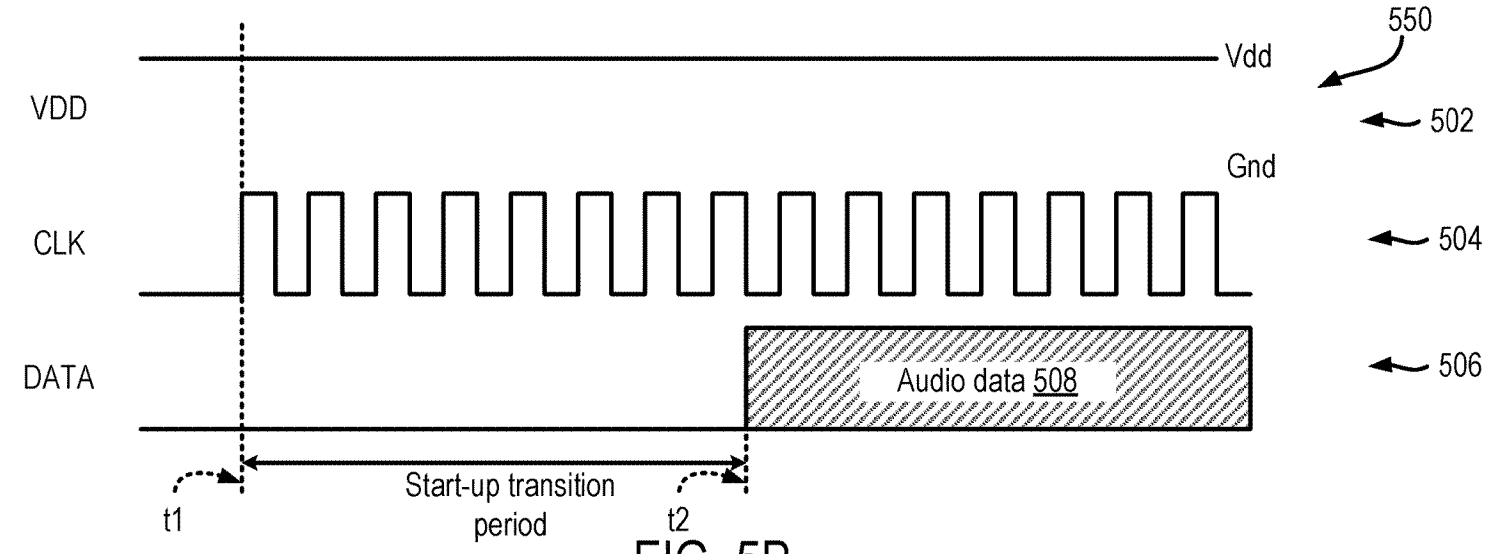
FIG. 5B shows an example timing diagram illustrating a start-up transition period after a wake-up event.

FIG. 5B shows an example timing diagram 550 illustrating a start-up transition period after a wake-up event. In particular, in the example shown in FIG. 5B the microphone 300 may be placed in a "sleep" mode by an external device by disabling the clock signal at the CLK contact of the microphone 300. As an example, the disabling the clock signal can include reducing the frequency of the clock signal to below a threshold, or reducing the voltage level of the clock signal below a threshold voltage level. When the clock signal at the CLK contact is above the threshold voltage and frequency at time t1, the controller 314 can determine that the start-up transition period has begun.

The start-up transition period can be a period when one or more components of the electrical circuit 304 initialize prior to providing the audio signal to the DATA contact. For example, after the voltage transitions from a low value to a value greater than a threshold value Vth, the charge pump 308 begins to charge the appropriate electrical components to increase the voltage across the transducer 302. The transducer 302 after receiving the voltage, may take some time to reach a steady state, which can be a state in which the electrical signal output by the transducer 302 can be considered a faithful representation of the sensed sound. Other electrical components, such as the SCC 306 and the ADC 316, which may include passive and active electrical components also may need time to reach a steady state of operation. During the start-up transition period, it preferable not to output audio data on the DATA contact.

Referring again to the process 400 shown in FIG. 4, the controller 314 after the beginning of the start-up transition period can communicate data other than audio data on the DATA contact (404). Thus, the start-up transition period, during which no digital audio signal is output on the DATA contact, can instead be utilized to communicate data other than the audio data. Referring to FIG. 3, the controller 314 can output a selection signal to the selection control input IN of the selection circuit 318 to cause the selection circuit 318 to not allow the output of the ADC 316 to be propagated to the output of the selection circuit 318.

Figure 6A:
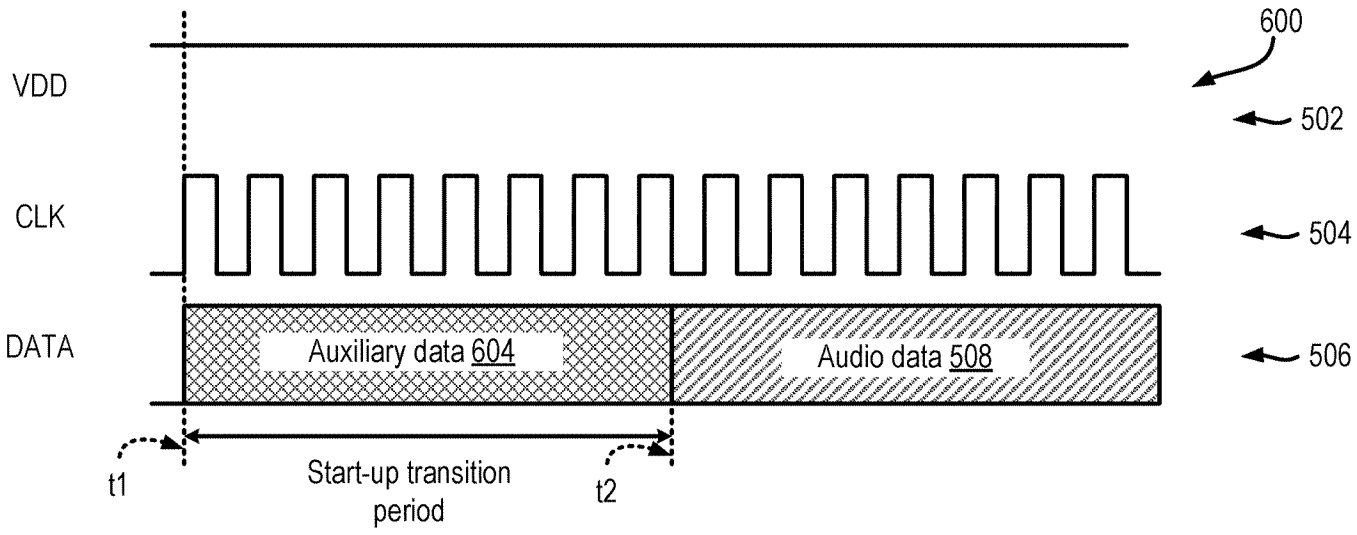
FIG. 6A shows an example timing diagram illustrating communicating auxiliary data during the start-up transition period.

FIG. 6A shows an example timing diagram 600 illustrating communicating auxiliary data during the start-up transition period. The controller 314 can output auxiliary data 604 during the start-up transition period. Referring to FIG. 3, in some examples, the controller 314 can access auxiliary data stored in memory 310, and transmit the auxiliary data on the DATA contact during the start-up transition period. In particular, the controller 314 can convert the digital auxiliary data into a digital signal representative of the auxiliary data, and provide the digital signal at an input of the selection circuit 318. In addition, the controller 314 can output a selection signal to the selection control input IN of the selection circuit 318 to cause the selection circuit 318 to allow the digital signal output by the controller 314 to be output by the selection circuit 318. Thus, any signal output by the ADC 316 is blocked from being output to the DATA contact. The controller 314 may also output a control signal to the CTRL input of the transceiver 320 to switch the operation of the transceiver 320 into transmit mode. The transceiver 320 can then output the signal that is representative of the auxiliary data on the DATA contact.

Figure 6B:
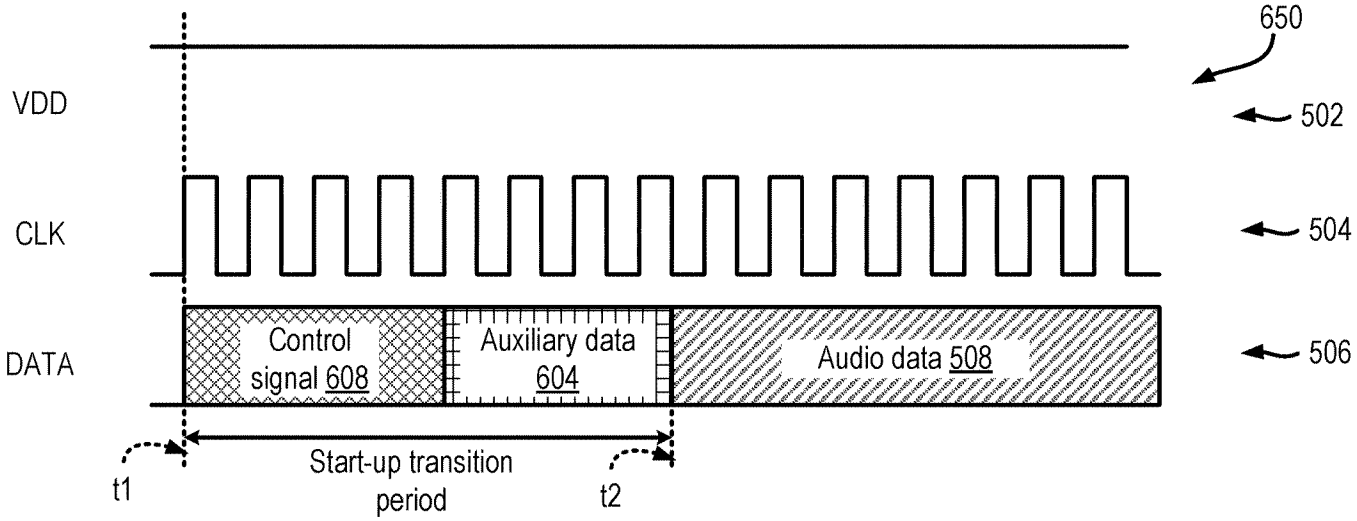
FIG. 6B shows an example timing diagram illustrating communicating control signals and data other than audio data during the start-up transition period.

FIG. 6B shows an example timing diagram 650 illustrating communicating control signals and data other than audio data during the start-up transition period. In contrast with the example illustrated in FIG. 6A, where the microphone 300 only outputs or transmits auxiliary data 604 during the start-up transition period, in the example shown in FIG. 6B, the microphone 300 also receives control signal 608 during the start-up transition period. As mentioned above, the microphone 300 can be coupled to other microphones or external consuming devices via the DATA contact. During the start-up transition period, the controller 314 can also receive control signals 608 that can provide instructions or information to the microphone 300. For example, the control signal can include request or instructions to the microphone to output auxiliary data 604. Responsive to the request for auxiliary data, the controller 314 can output the auxiliary data on the DATA contact. In some other examples, the control signals can include calibration or sensitivity data from another microphone also coupled to the same interconnect that is coupled to the DATA contact. the controller 314 can utilize the calibration or sensitivity data to adjust the sensitivity or gain of the electrical components of the microphone 300.

In some instances, the controller 314 can output the auxiliary data along with sync data. As mentioned above, the memory 310 can store sync data that can include bit patterns that indicate start and stop of auxiliary data. The controller 314 can output the sync data before and after the auxiliary data. An external device coupled to the DATA contact can detect the sync bit patterns in the data output by the microphone 300 to determine the start and the stop of auxiliary data.

Referring again to the process 400 shown in FIG. 4, the controller 314 can continue to communicate data on the DATA contact until the start-up transition time is complete (400). Referring to FIGS. 5A-6B, the start-up transition period can end at time t2. In some instances, the controller 314 can sense the voltage or current levels of one or more components (such as the charge pump 308, the transducer 302, the SCC 306, the ADC 316, etc.) to determine whether the components have reached a steady state. If the components have reached a steady state, the controller 314 can determine that the start-up transition period has ended. In some instances, the controller 314 may start a timer at the start (t1) of the start-up transition period, and determine that the start-up transition period has ended (t2) when the timer reaches a predetermined threshold value. The threshold value can be experimentally determined.

After the start-up transition period is complete, the controller 314 can cease communicating data via the DATA contact (408). For example, the controller 314 can control the selection circuit 318 to select the signal at the input of the selection circuit 318 that is coupled to the ADC 316 and provide that signal for output to the DATA contact. The controller 314 can also control the transceiver 320 to operate in transmission mode, and transmit the audio data on the DATA contact (410).

Figure 7:
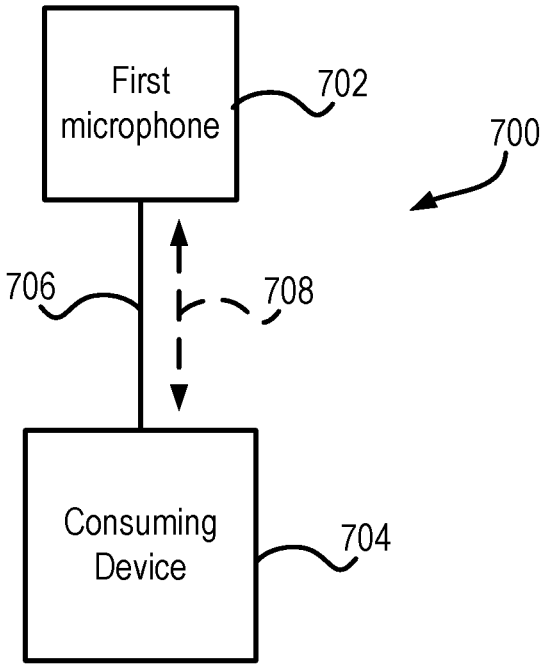
FIG. 7 shows an example configuration in which the microphone can be connected to external devices via the DATA contact.
Figure 8:
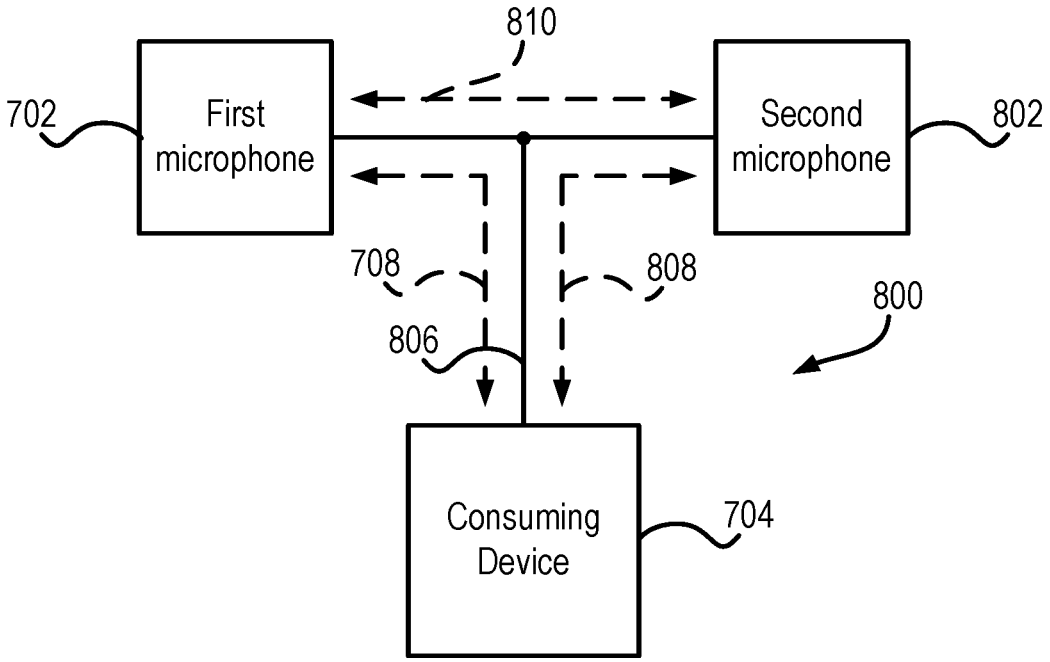
FIG. 8 shows another example configuration in which the microphone can be connected to external devices via the DATA contact.

FIGS. 7 and 8 show example configurations in which the microphone 300 can be connected to external devices via the DATA contact. In particular, FIG. 7 shows a first configuration 700 in which a first microphone 702 is coupled to a single consuming device 704. The microphone 300 discussed above in relation to FIGS. 1-6B can be utilized to implement the first microphone 702. A common interconnect 706 can be coupled to the DATA contact of the first microphone 702. The common interconnect 706 also can be coupled to the consuming device 704. In the first configuration 700, the first microphone 702 and the consuming device can communicate data other than audio data during a start-up transition period of the first microphone 702. The data communication can be bidirectional. That is, the first microphone 702 can receive control signals (e.g., control signals 608 shown in FIG. 6B) and can transmit auxiliary data (e.g., auxiliary data 508 shown in FIGS. 6A and 6B). After the start-up transition period is complete, the first microphone 702 can begin transmitting audio data to the consuming device 704.

FIG. 8 shows a second configuration 800 in which the first microphone 702 is coupled to a second microphone 802 and the consuming device 704 over a common interconnect 806. The second configuration 800 can be a stereo configuration, in which the first microphone 702 is configured to capture a first channel and the second microphone 802 is configured to capture a second channel of sound. In some examples, the SEL contacts of the first and the second microphones 702 and 802 can be connected to opposite rails of voltages, such that the first and the second microphones 702 and 802 output data on opposite edges of the clock cycle. The microphone 300 discussed above in relation to FIGS. 1-6B can be utilized to implement the second microphone 802. The common interconnect 806 can be coupled to the DATA contacts of both the first microphone 702 and the second microphone 802. In this configuration, the first microphone 702 and the consuming device 704 can communicate a first set of data 708 via the DATA contact of the first microphone. The second microphone 802 and the consuming device 704 can communicate a second set of data 808 via the DATA contact of the second microphone 802. The first microphone 702 and the second microphone 802 can communicate a third set of data 810 via their respective DATA contacts. The first, second, and third sets of data 708, 808, and 810 can be communicated during the start-up transition periods of the first microphone 702 and the second microphone 802. The first and second microphones 702 and 802 can exchange the third set of data that can include values of their respective parameters, such as sensitivity, gain, status, etc. After the completion of the start-up transition period, the first and the second microphone 702 and 802 can output respective audio data on the common interconnect 806 on their respectively assigned clock edges.

Figure 9:
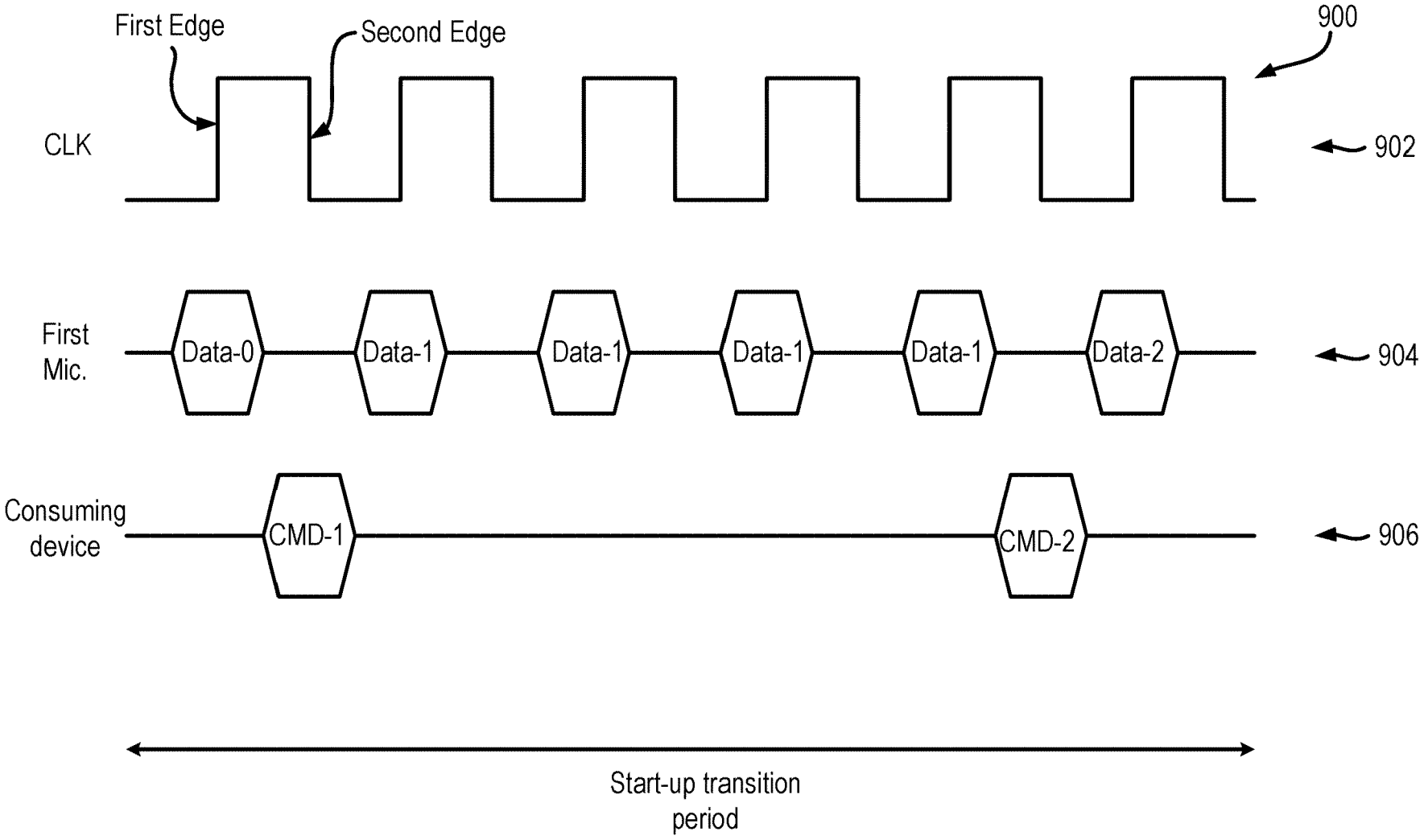
FIG. 9 shows a first timing diagram illustrating an example communication between the first microphone and the consuming device shown in FIG. 7.

FIG. 9 shows a first timing diagram 900 illustrating an example communication between the first microphone and the consuming device shown in FIG. 7. The first timing diagram 900 includes a clock waveform 902, a first data waveform 904 associated with the first microphone 702, and a second data waveform 906 associated with the consuming device 704. The first timing diagram 900 illustrates communication of data other than audio data during the start-up transition period. The first microphone 702 and the consuming device 704 can share the same clock signal. In the example shown in FIG. 9, the first microphone 702 and the consuming device 704 can be configured to transmit on alternate edges of the clock signal. For example, the first microphone 702 can be configured to output data on the first edge (rising edge) of the clock signal shown in the clock waveform 902 and the consuming device 704 can be configured to output data on the second edge (falling edge) of the clock signal.

At the beginning of the start-up transition period, the first microphone 702 can output Data-0 on the rising edge of the clock signal. As discussed above in relation to FIG. 3, the controller 314 can control the selection circuit 318 and the transceiver 320 to output or transmit data provided by the controller 314 via the DATA contact. Before the arrival of the falling edge of the clock signal the controller 314 can control the transceiver 320 to switch to receive mode. At the falling edge of the clock cycle, the consuming device 704 can output a first control signal, CMD-1, including instructions to output microphone status data. Before the arrival of the following rising edge, the consuming device 704 can switch into receive mode. The controller 314 can receive the control signal, and determine the data requested by the consuming device, and access the memory 312 retrieve the requested data. At the following rising edge, the controller 314 can switch to transmit mode, and output the requested data as Data-1 on the common interconnect 706. In some instances, the first microphone 702 can output Data-1 multiple times during the start-up transition period. In one example, the first microphone 702 may output the same data repeatedly every rising edge of the clock cycle until it receives a new control signal or until the start-up transition period is complete. On a subsequent falling edge of the clock cycle, the consuming device 704 can output a second control signal CMD-2. The first microphone 702 can process the control signal, and in response output the requested data as Data-2 on the immediately following or a subsequent rising edge. The communication protocol to send and receive data in a time-multiplexed manner can be implemented in a manner different from the one shown in FIG. 9. For example, the first microphone 702 and the consuming device 704 can switch the clock edge over which their respective data is transmitted. In another example, the first microphone 702 and the consuming device can be assigned time windows exceeding multiple clock cycles during which only one device transmits on both clock edges.

Figure 10:
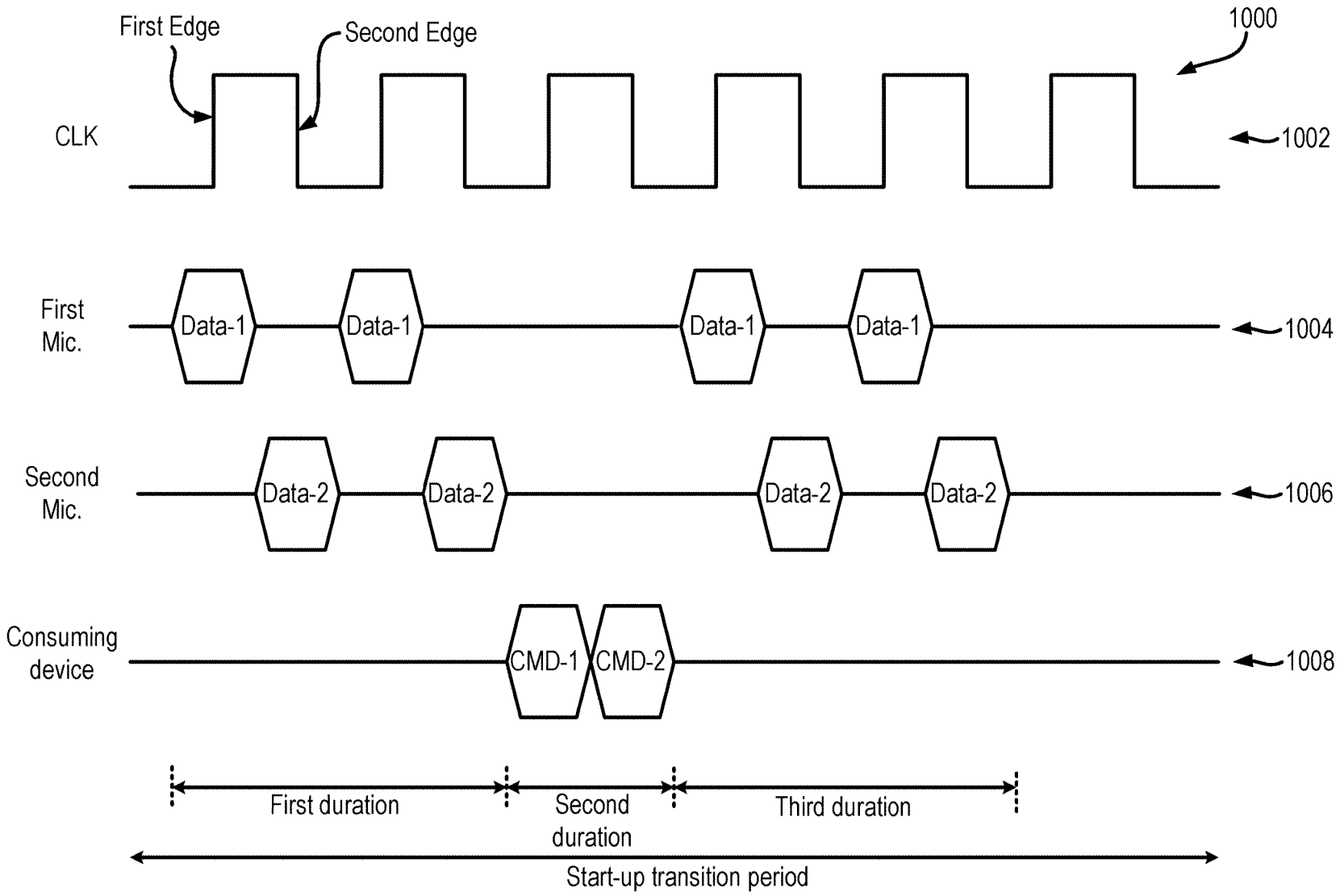
FIG. 10 shows a second timing diagram illustrating an example communication between the first microphone, the second microphone, and the consuming device shown in FIG. 8.

FIG. 10 shows a second timing diagram 1000 illustrating an example communication between the first microphone, the second microphone, and the consuming device shown in FIG. 8. The second timing diagram 1000 includes a clock waveform 1002, a first data waveform 1004 associated with the first microphone 702, a second data waveform 1006 associated with the second microphone 802, and a third data waveform 1008 associated with the consuming device 704. The second timing diagram 1000 illustrates communication of data other than audio data during the start-up transition periods of the first and the second microphones 702 and 802. The first microphone 702, the second microphone 802, and the consuming device 704 can share the same clock signal represented by the clock waveform 1002. As there are three devices coupled to the common interconnect 806 and there are only two clock edges, a communication protocol can be adapted where during a first duration only the first and the second microphones 702 and 802 communicate data over the common interconnect 806, and the consuming device 704 is switched to receive mode; a second duration during which only the consuming device transmits and the first and the second microphones 702 and 802 are switched to receive mode; and a third duration where the devices switch back to the configuration during the first duration. During the first duration, for example, the first and the second microphones 702 and 802 can communicate data other than audio data to each other or to the consuming device 704. In the second duration, the consuming device 704 can send control signals to the two microphones. The communication protocol can assign the clock edge over which each microphone receives control signals. For example, the first microphone 702 can be configured to receive the control signal CMD-1 only on the rising edge of the clock signal, and the second microphone 802 can be configured to receive the control signal CMD-2 on the falling edge of the clock signal. Of course, the configuration shown in FIG. 10 is only an example, and other communication protocols can be employed to facilitate communication between the three devices.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A digital microphone assembly comprising:

a housing having an external device interface with a plurality of contacts including a data contact;

an electro-acoustic transducer disposed in the housing and configured to generate an electrical signal in response to sound; and an electrical circuit disposed in the housing and electrically coupled to contacts of the interface, the electrical circuit including:

an analog-to-digital converter (ADC) configured to convert the electrical signal to audio data; and a controller configured to receive a control signal, other than the audio data, via the data contact of the external device interface during a start-up transition period of the microphone assembly, wherein the controller is configured to communicate the audio data via the data contact of the external device interface only after the start-up transition period is complete, wherein the controller is configured to communicate data other than the audio data via the data contact during the start-up transition period based on a power supply voltage exceeding a non-zero supply voltage threshold.

2. The assembly of claim 1, wherein the start-up transition period is a period during which a portion of the electrical circuit is initialized prior to providing the audio data to the data contact of the external device interface, and wherein the controller is configured to communicate data other than the audio data via the data contact after a clock frequency exceeds a clock frequency threshold during the start-up transition period.

3. The assembly of claim 1, wherein the controller is configured to utilize no other contact other than the data contact to communicate data and the audio data.

4. The assembly of claim 1, the electrical circuit further comprising memory configured to store auxiliary data, the controller configured to communicate data by transmitting the auxiliary data with a sync pattern via the data contact of the external device interface during the start-up transition period.

5. The assembly of claim 4, wherein the auxiliary data is any one of microphone calibration, performance, status, or diagnostic data.

6. The assembly of claim 4, wherein the controller is configured to communicate data by transmitting the auxiliary data via the data contact multiple times during the start-up transition period.

7. The assembly of claim 1, the electrical circuit further comprising memory configured to store auxiliary data, the controller configured to communicate data by transmitting the auxiliary data with a sync pattern via the data contact of the external device interface during the start-up transition period in response to receiving the control signal.

8. The assembly of claim 1, wherein the controller is configured to complete the start-up transition period based on a voltage of at least one component of the electrical circuit exceeding a threshold value.

9. A method for communicating over a data contact of an external device interface of a digital microphone assembly having a housing, the method comprising:

generating, by an electro-acoustic transducer disposed in the housing, an electrical signal in response to sound;

converting, by an analog-to-digital converter (ADC), the electrical signal to audio data;

communicating, by a controller, data other than the audio data via the data contact of the external device interface during a start-up transition period of the microphone assembly, wherein the controller is configured to communicate the audio data via the data contact of the external device interface only after the start-up transition period is complete, wherein communicating data other than the audio data further comprises communicating data other than the audio data via the data contact during the start-up transition period based on a power supply voltage exceeding a non-zero supply voltage threshold, wherein communicating the data comprises transmitting auxiliary data, stored in memory, with a synch pattern via the data contact of the external device interface during the start-up transition period, and wherein communicating the data comprises transmitting the auxiliary data via the data contact multiple times during the start-up transition period.

10. The method of claim 9, wherein communicating the data comprises communicating, by the controller, data other than the audio data via the data contact of the external device interface after a clock frequency exceeds a clock frequency threshold during the start-up transition period, and wherein the start-up transition period is a period during which a portion of an electrical circuit comprising the ADC and the controller is initialized prior to providing the audio data to the data contact of the external device interface.

11. The method of claim 9, wherein communicating the data comprises the communicating, by the controller, the data and the audio data via no other contact than the data contact.

12. The method of claim 9, wherein the auxiliary data is any one of microphone calibration, performance, status, or diagnostic data.

13. The method of claim 9, further comprising receiving a control signal via the data contact of the external device interface during the start-up transition period.

14. The method of claim 13, wherein communicating the data further comprises transmitting auxiliary data, stored in memory, with a synch pattern via the data contact of the external device interface during the start-up transition period in response to receiving the control signal.

15. The method of claim 14, further comprising receiving the control signal via the data contact during a first duration of the start-up transition period and by transmitting the auxiliary data via the data contact during a second duration following the first duration.

16. The method of claim 9, further comprising completing, by the controller, the start-up transition period based on a voltage of at least one component of the microphone assembly exceeding a threshold value.

17. A digital microphone assembly comprising:

a housing having an external device interface with a plurality of contacts including a data contact;

an electro-acoustic transducer disposed in the housing and configured to generate an electrical signal in response to sound; and an electrical circuit disposed in the housing and electrically coupled to contacts of the interface, the electrical circuit including:

an analog-to-digital converter (ADC) configured to convert the electrical signal to audio data; and a controller configured to communicate data, other than the audio data, via the data contact of the external device interface during a start-up transition period of the microphone assembly, communicate the audio data via the data contact of the external device interface only after the start-up transition period is complete, and receive a control signal via the data contact of the external device interface during the start-up transition period.

18. The assembly of claim 17, wherein the controller is configured to receive the control signal via the data contact during a first duration of the start-up transition period and transmit auxiliary data via the data contact during a second duration following the first duration.

* * * * *